United States Patent [19]

Morrison

[11] 4,175,292

[45] Nov. 27, 1979

[54] SINK MOUNTING MEANS

[76] Inventor: Russell F. Morrison, 62 NW. Caribou La., Roseburg, Oreg. 97470

[21] Appl. No.: 894,684

[22] Filed: Apr. 10, 1978

[51] Int. Cl.[2] ..... E03C 1/18

[52] U.S. Cl. ..... 4/187 A; 4/173 M

[58] Field of Search ..... 4/187 R, 187 A, 173 M, 4/1; 312/140.4

[56] References Cited

U.S. PATENT DOCUMENTS

| | | | |
|---|---|---|---|
| 1,727,159 | 9/1929 | Coulter | 4/187 A |
| 2,549,415 | 4/1951 | Bonnell | 4/187 A |
| 2,843,855 | 7/1958 | Hammer | 4/187 A |
| 2,883,677 | 4/1959 | Green | 4/187 A |
| 2,996,730 | 8/1961 | Hornik | 4/187 A |
| 3,001,209 | 9/1961 | Hammer | 4/187 A |
| 3,013,851 | 12/1961 | Maron | 4/187 A |
| 3,110,040 | 11/1963 | Richardson | 4/187 A |
| 3,386,108 | 6/1968 | Juergens | 4/187 A |

FOREIGN PATENT DOCUMENTS

| | | | |
|---|---|---|---|
| 209430 | 7/1957 | Australia | 4/187 A |
| 779648 | 7/1957 | United Kingdom | 4/187 A |

*Primary Examiner*—Henry K. Artis

*Attorney, Agent, or Firm*—James D. Givnan, Jr.

[57] ABSTRACT

Sink mounting means utilizing a member of angular cross section having a web for securement to a cabinet counter edge. A sink support member is carried by an inwardly directed flange of the member of angular section which member may be of a closed frame type configuration, straight or of curved configuration with or without adjustment bars extending therebetween to lock the members in a unitary, fixed relationship to facilitate attachment of the mounting means to the counter edge which is done independently from the later inserted sink or lavatory.

12 Claims, 14 Drawing Figures

SINK MOUNTING MEANS

BACKGROUND OF THE INVENTION

As a result of the increased usage of built-in appliances, such as dishwashers, compactors, surface mounting cooking units, and other appliances built into cabinet counters, the area of the counter has been gradually reduced over the years. To further complicate the situation, the cabinet counter into which the sink was installed, prior to the occurence of plywood and particleboard, was from 26 to 27 inches in depth. However, as plywood and particleboard have now become the common cabinet materials in use today, and are manufactured in 48 inch widths, it is common practice of cabinet makers to rip each 48 inch sheet into two strips 24 inches in width to serve as cabinet counters. From this cabinet counter of 24 inches width must be deducted ¾ of an inch for the cabinet front thickness, ¾ of an inch for the cabinet overhang, and at times ¾ of an inch for the cabinet counter back splash. The remaining surface depth of the cabinet counter available for installation of a sink, commonly 21 inches in width, is 21¾ inches.

As a result of the diminshed counter top area, it has become increasingly difficult to install and tighten known clamps which require a counter underside to bear against. Furthermore, the prior art sink rim clamps are designed only to accommodate a cabinet counter thickness of ¾ of an inch. It is, however, not uncommon to encounter a cabinet counter 1½ inches in thickness at the points where the rim clamps are to be installed. As a result of the above stated inconveniences the installer must oftimes chisel notches into the cabinet front and sides, as well as into the underside of the cabinet counter to facilitate the installation of rim securing clamps utilized in prior art installation procedures thus increasing the cost of sink installation. Also proximity of cabinet partitions and front to the counter openings is often such that the installer is unable to attach and secure the clamps to the counter underside.

SUMMARY OF THE PRESENT INVENTION

The present invention is embodied within sink mounting means for securement to a cabinet counter for retention of a subsequently installed sink.

The present mounting means includes members of angular section for securement in either a continuous or non-continuous manner to a counter edge defining an opening for sink reception. In distinction to the prior art type of clamps wherein the sink is supported by a surface trim ring or frame, the present sink mounting means includes straight and/or curved elongate members of angular section for securement to the counter prior to sink installation. The prior art clamps in common use are installed while supporting sink weight making the installation extremely awkward and even risky as sinks may fall on the installer during installation efforts. In distinction to prior art trim rings, the surface trim ring assembly of the present invention is not a load bearing member thus permitting convenient installation of same.

In one form of the present invention, the mounting means is preliminarily formed into a closed or frame type configuration. Other versions of the invention include straight or curved members or a combination of both with or without adjustable bars therebetween. Accordingly the invention in a non-adjustable form may be of a size to accommodate a common sink size, for example, 21 inches by 32 inches. Interchangeable lockable adjustment bars usable with other forms of the invention permit the present mounting components to be formed into a closed frame to accommodate a very wide range of sink sizes. Locking means are provided to enable complete assembly and locking of the mounting means to a sink accommodating size prior to attachment to the inner periphery of the counter sink opening. The mounting means, during such installation, is highly accessible to the installer and bears no sink load during installation to greatly facilitate installation.

Important objects of the present invention include sink mounting means closely confined adjacent the inner marginal area of the counter opening so as to not conflict with below counter encumbrances such as adjacent, partitions walls and appliances; mounting means permitting sink removal simply by lifting of same away from sink support members to accordingly facilitate sink removal and replacement or reinstallation after the application of new counter top material; mounting means permitting the sink to be operational without a surface trim ring in order that same may be applied lastly in a new home to avoid damage by construction workers; mounting means accommodating a wide range of sink sizes and any counter top thickness while requiring a relatively low inventory of components; mounting means which avoids chipping or crazing of sink surfaces; mounting means enabling the use of other than steel surface trim rings which may be of lightweight colored plastic as they are not load bearing; mounting means greatly reducing sink installation time and risk of injury.

DETAILED DESCRIPTION OF THE PREFERRED EMBODIMENT

Figures 1, 2, 3, 4, 5, 6, 7:
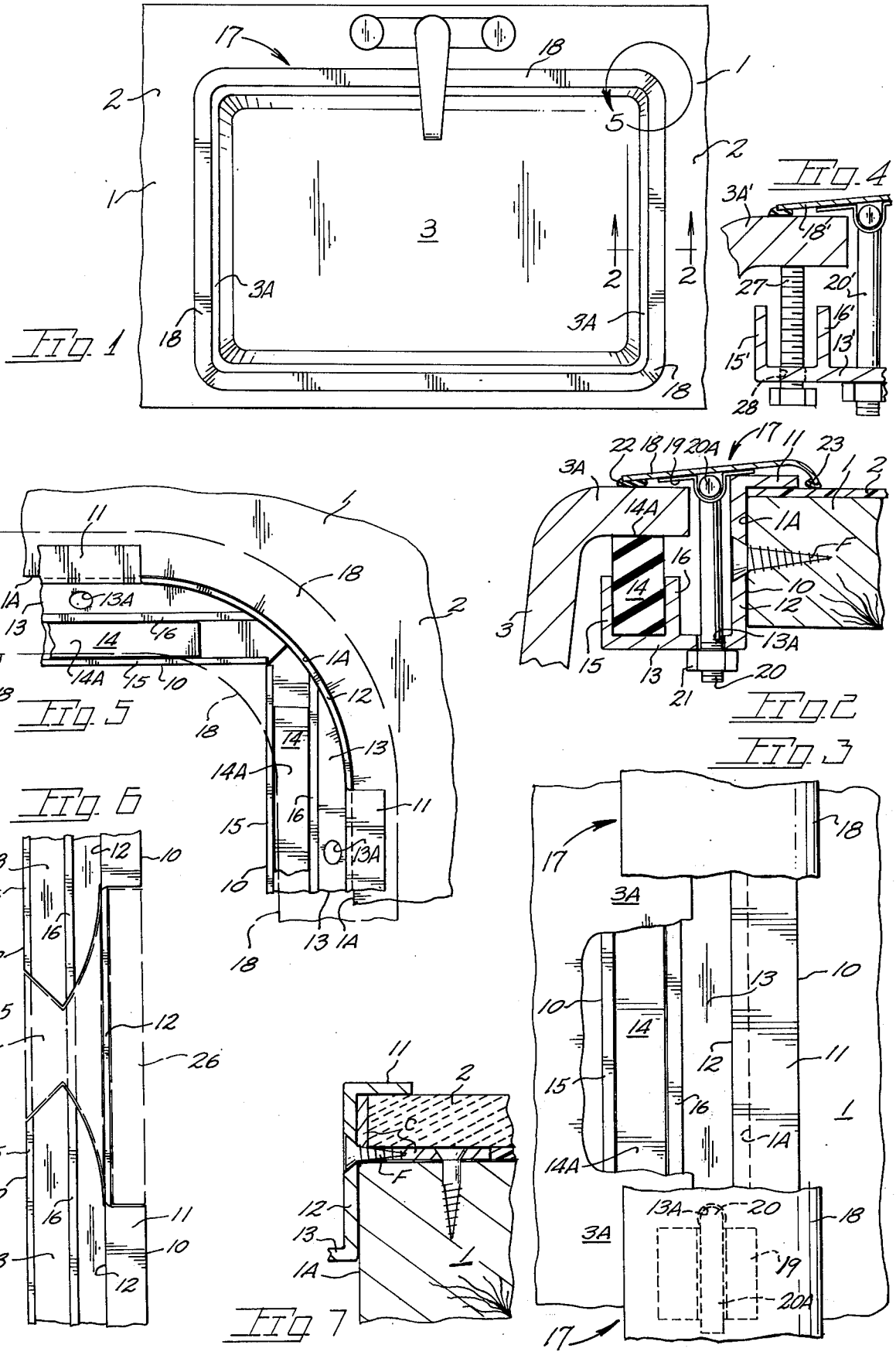
FIG. 1 is a plan view of a sink or lavatory installed using the present mounting means.
FIG. 2 is a vertical sectional view of the mounting means taken along the line 2—2 of FIG. 1.
FIG. 3 is a plan view of FIG. 2.
FIG. 4 is a view similar to FIG. 2 showing a modified form of the mounting means.
FIG. 5 is an enlarged plan view of that area circled at 5 in FIG. 1 with fragments broken away for purposes of illustration.
FIG. 6 is a plan view of a segment of sink mounting means relieved to permit forming of a corner segment.
FIG. 7 is a vertical sectional view of the present sink mounting means including an adapter clip enabling use of the mounting means with a tile covered counter.

With continuing attention to the accompanying drawings, the reference numeral 1 indicates the top surface of a cabinet counter of the type found in kitchens and bathrooms. Characteristically such counter tops receive an overlying protective layer of material as at 2, such commonly being of a durable synthetic plastic or ceramic material. A counter sink opening is defined by a continuous counter edge 1A which is offset from the perimetrical edge of a sink flange 3A of a sink or lavatory 3.

The present sink mounting means includes, in one form, a continuous frame member 10 of angular section secured in abutment against cabinet edge 1A such securement being as by threaded fasteners as at F in FIG. 2. A suitable adhesive may be utilized if so desired. Said angular member comprises an upright web 12 and an inwardly directed flange at 13. An upper flange at 11 restingly engages the counter top to facilitate attachment of the present mounting means to the counter edge. As the present mounting means does not engage the underside of counter 1, the thickness of said counter is importantly of no concern. Accordingly the installer is not confronted with unexpected counter thicknesses resulting in various installation problems, as earlier mentioned, experienced with other sink mounting arrangements.

Inwardly directed flange 13 is adapted to receive a sink support member at 14 the upper surface 14A of which receives the sink flange 3A in a rested manner. Sink support member 14 is preferably of an elastomeric nature preferably a neoprene rubber block but which may otherwise be embodied of a rigid material. Said sink support member is frictionally confined between oppositely disposed walls 15 and 16 integral with flange 13. The vertical dimension of support member 14 will obviously vary in accordance with the thickness of sink flange 3A with the objective being the upper surface of the sink flange being positioned substantially coplanar with the upper surface of counter 1.

A surface trim ring assembly is indicated generally at 17 which includes a continuous ring member 18 which conventionally overlies a marginal area of sink flange 3A and a marginal area of counter 1 to conceal the gap between the sink flange and counter edge. Said ring is provided on its underside with spaced apart anchor bolts 20, each held by a plate 19 slidably and pivotally receiving a horizontally turned upper end 20A of the bolt. The surface trim ring 18 is biased downwardly by means of a nut element 21. To assure a watertight seal between the trim ring and sink flange 3A and the counter top surface, peripheral beads 22 and 23 of a sealant such as neoprene are applied to the ring. The trim ring assembly 17 is the last component installed of the present mounting means and entails the downward insertion of the lower ends of bolts 20 through bolt receiving openings 13A in flange 13. Said openings may be somewhat elongated to facilitate insertion.

In FIG. 5 a curved or corner segment of member 10 is shown wherein flange portions of said member 10 are shown cut away enabling the bending of said member into curved configuration. With attention to FIG. 6, a cut or punched out segment of inwardly directed flange 13 is shown in phantom lines at 25 to indicate that portion removed while, similarly, a portion of upper flange 11 is indicated in phantom lines at 26. Web 12 may then be shaped on a radius corresponding to that of the counter corner normally $1\frac{3}{4}$ inches. Obviously the configurations of cutout portions 25 and 26 will vary in accordance to suit the radius of the counter corner.

As shown in FIG. 7, an angular clip C may be utilized to receive a web attaching fastener F.

With attention to FIG. 4, an alternative sink support member is disclosed in the form of a leveling bolt 27 in threaded engagement with an opening 28 in a modified inwardly directed flange 13'. Other components of the surface trim ring assembly and the sink of FIG. 4 are identified by prime reference numerals which correspond to reference numerals identifying similar parts in the first form of the invention. In the present modification, the sink rim 3A' is at all times only in rested engagement with the upper end of leveling bolts 27 and accordingly the sink is not susceptible to severe fastener loads as encountered by other sink mounting arrangements which can crack or craze sink surfaces.

Figures 8, 9, 10, 11:
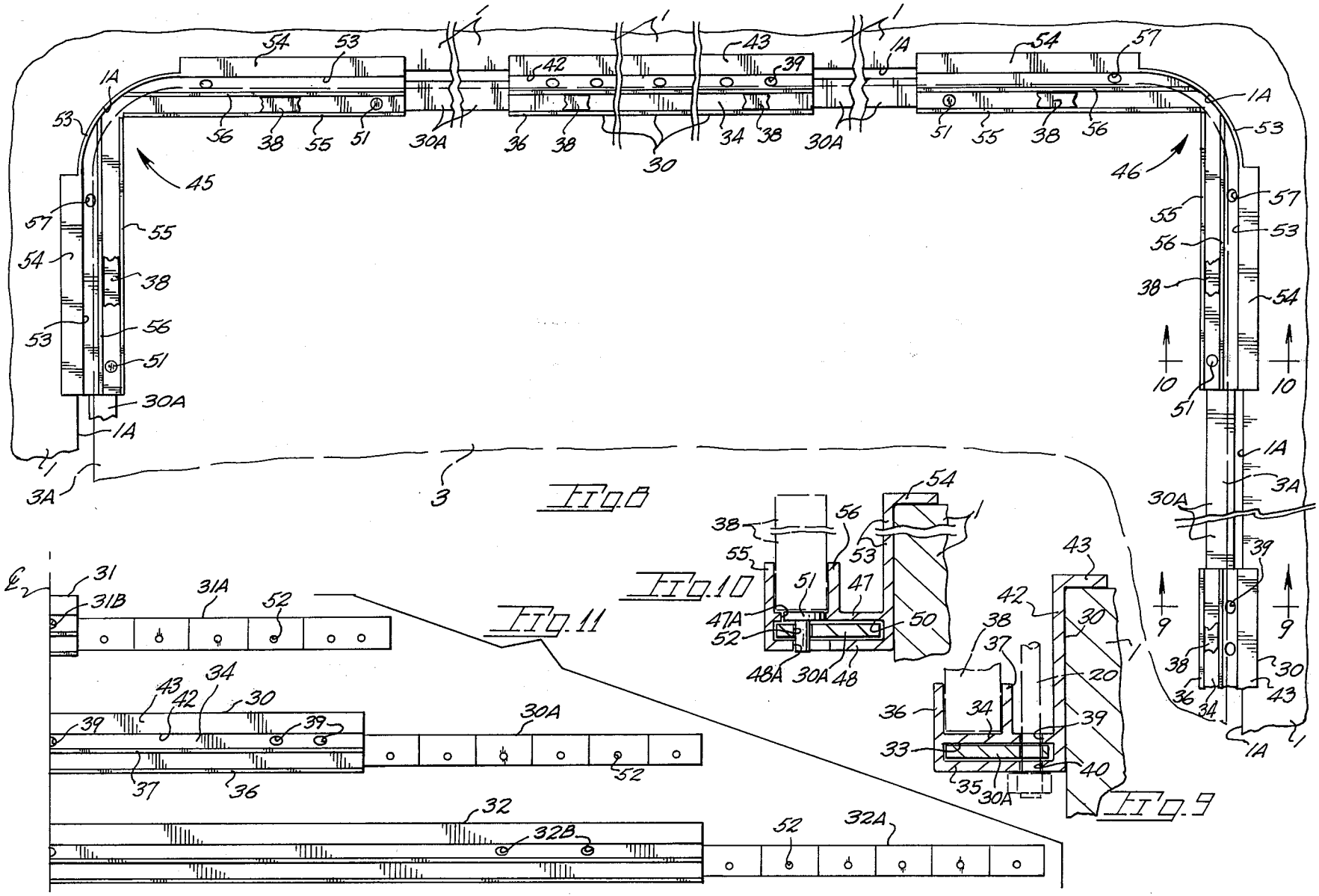
FIG. 8 is a fragmentary plan view of a counter top with an adjustable form of the present mounting means in place thereon about a sink receiving counter opening.
FIG. 9 is a vertical sectional view taken along line 9—9 of FIG. 8.
FIG. 10 is a vertical sectional view taken along line 10—10 of FIG. 8.
FIG. 11 is a composite plan view of different sized adjustment bars terminating along their respective center lines.

With attention now to FIGS. 8, 9, 10 and 11, the mounting means shown therein is adjustable for various sink sizes and comprises spaced apart straight and curved or corner members of angular section interconnected by adjustment bars. A cabinet counter upper surface is again indicated at 1 with a sink receiving opening defined therein by a counter peripheral edge 1A. Elongate members of angular section are indicated at 30 with adjustment bars 30A both members 30 typically shown in section in FIG. 9. Other angular members at 31 and 32 (FIG. 11) are of other lengths as are the adjustment bars 31A, 32A associated therewith the use of a specific combination of said members being determined by the sink size being installed. In FIG. 8, angular members 30 and their adjustment bars 30A are utilized to vary both length and width of the present mounting means, however, it will be understood that various combinations of members will be used to accommodate the length and width of the sink being installed. For example, angular members at 31 and 32 are of different lengths and are fully interchangeable with angular members 30 in FIG. 8 to comprise a mounting for a different sink size. The adjustment bars shown associated with each of said angular members may be secured to their respective member by spot welding or the like within a channel as at 33 (FIG. 9) defined by inwardly directed flanges 34 and 35 of the member. Flange 34, in similarity to the first form of the invention has a pair of upstanding walls 36, 37 between which is securely confined an inserted sink support member 38 of the type earlier mentioned. Inwardly directed flanges 34, 35 have aligned apertures 39 and 40 formed therein at intervals to receive a bolt 20 of a surface trim ring assembly of the type earlier described but, of course, of a different size and with different bolt spacing. As the spacing of surface trim ring bolts 20 varies with the size of the surface trim ring it is necessary to provide the elongate angular members 30–32 with apertures 31B and 32B at different intervals as shown. The adjustment bars 30A–32A associated with each angular member 30–32 are correspondingly apertured for bolt reception. Each elongate angular member 30–32 additionally includes a web 42 and an upper flange 43 the latter for counter top engagement with the web being secured in the aforementioned manner.

The FIG. 8 version of the present invention includes a plurality of curved members of angular section a pair of which are indicated generally at 45 and 46 which are similar to that curved segment of the first form of the invention shown in FIG. 5. Each curved section includes a pair of straight portions typically shown in cross section in FIG. 10. For economy of manufacture members 30–32 and 45, 46 may be formed from the same stock preferably extruded aluminum.

With attention to FIG. 10, the curved members 45, 46 include inwardly directed flanges 47 and 48 spaced to provide a channel 50 for reception of an adjustment bar 30A–32A. For locking of the adjustment bars to a curved member, locking pins at 51 are provided each having a head and shank for flush insertion into flange apertures 47A and 48A and through an aperture 52 in the adjustment bar provided at one inch intervals. Accordingly the completely formed, rigid sink mounting means may be assembled into a unitary structure prior to setting of same into place and securement within the counter opening. The curved members of angular section 45,46 include a web as at 53 and an upper flange 54 for counter top engagement with the web being attached to the counter edge 1A as earlier described in the first form of the invention.

Sink support members 38 are received within walls 55, 56 on inwardly directed flange 47. Said flange is apertured at 57 (FIG. 8) for the reception of a trim ring assembly bolt 20.

Figure 12:
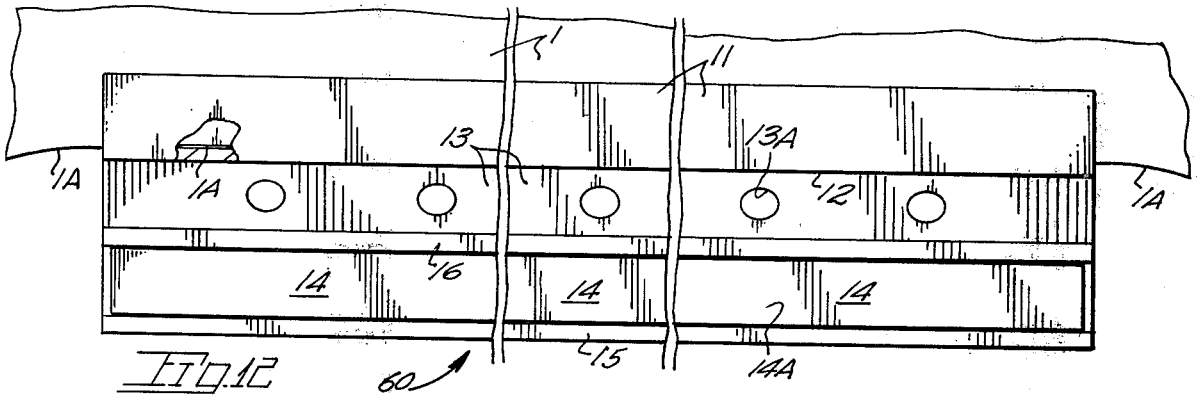
FIG. 12 is a plan view of elongate sink mounting means intended for use without an associated curved member.
Figure 13:
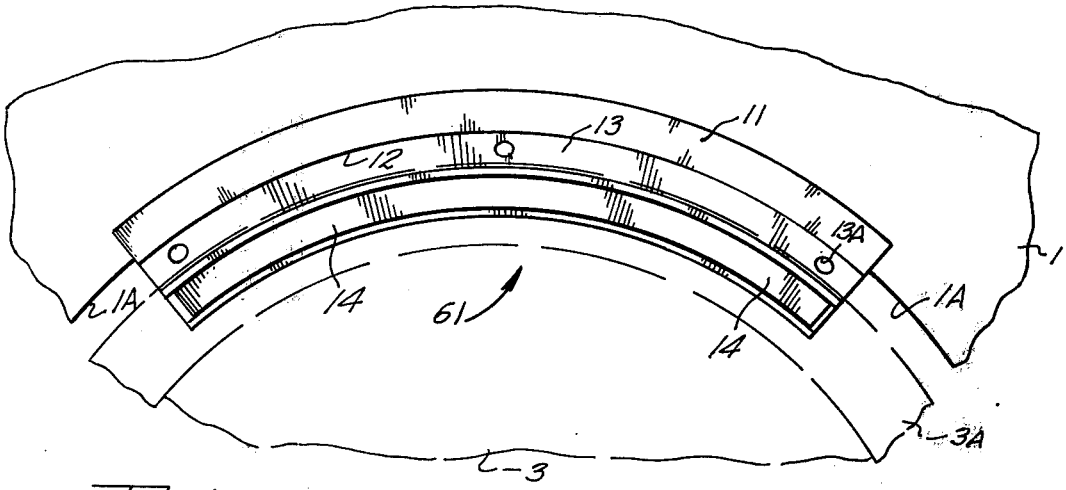
FIG. 13 is a plan view of elongate curved mounting means for use in the installation of a curved or oval sink.

In FIGS. 12 and 13, I show sink members of angular section of both straight and arcuate configuration respectively both similar in section to the first described form of the invention as shown in FIG. 2 and intended for use without corner members as such. For example, the straight member indicated generally at 60 is secured in place as earlier mentioned to a straight edge 1A of counter 1 while in FIG. 13 a curved member indicated generally at 61 is intended for use in mounting a sink of round or elliptical configuration.

Figure 14:
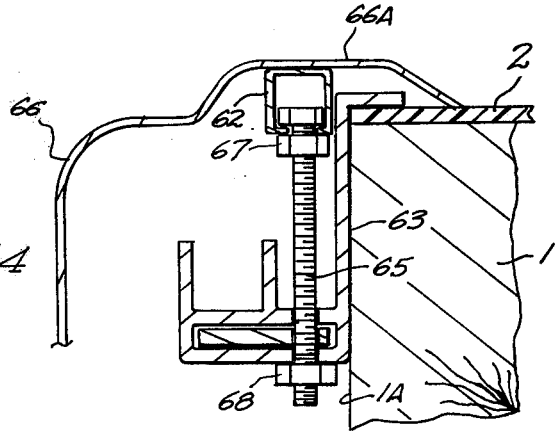
FIG. 14 is a vertical sectional view of the present mounting means modified for installation of a stainless steel sink.

In FIG. 14, a further modification is shown wherein the sink support member of angular section 63 is adapted to receive a bolt 65 the head 65A of which is carried within an inverted sink channel 62 integral with the steel sink flange 66A of a sink 66. Such sinks normally engage the counter top and do not require a separate surface trim ring. The member of angular section may be the same as the section shown in FIG. 9, or it may be similar to the section shown in FIG. 2 with the inserted member dispensed with. Bolt 65 is provided with a first nut 67 engaging the underside of channel 62 and a second nut 68 to draw the sink flange 63 into secure engagement.

In use, the sink opening is cut into the counter top 1 in the normal manner. If the sink is of a common size, the first described form of sink mounting means may be pre-formed and thence set into the opening and fastened to the counter edge. Sink support members are of a selected height to position the sink flange 3A to the desired level and the sink thereafter set into place whereafter the outlet is connected to provide an operable sink or lavatory. The trim ring assembly is installed lastly to avoid damage to same as can occur in a new home from other construction efforts.

In the adjustable form of the invention, viewed in FIGS. 8 through 11, additional steps are required, that of selecting the proper angular member 30–32 to suit the length and width of a sink such being other than a common size. The sink mounting means will be assembled and locked in the desired configuration by locking pins 51 insertable through adjustment bar openings 52 and aligned openings 47A–48A in curved members 45,46 whereafter the sink mounting means is installed.

The trim ring assembly 17 is installed lastly by insertion of assembly bolts 20 being downwardly inserted through somewhat enlarged opeings in the inwardly directed flanges of the members of angular section for subsequent securement by the application of nut elements 21.

While I have shown but a few embodiments of the invention it will be apparent to those skilled in the art that the invention may be embodied still otherwise without departing from the spirit and scope of the invention.

Having thus described the invention, what is desired to be secured under a Letters Patent is:

1. Sink mounting means for attachment to a cabinet counter of any thickness defining a sink receiving opening, said sink mounting means including a member of angular section having an upright web adapted for abutting securement against the vertical counter edge defining the sink receiving opening and an inwardly directed flange disposed below a plane containing the counter upper surface, said inwardly directed flange located within said sink receiving opening and defining an upwardly opening recess, a sink support member disposed within said recess, fastening means for securing the web of the sink mounting member to the vertical counter edge, said support member having an upper surface on which the underside of a sink flange is restingly supported, said inwardly directed flange having openings at intervals to receive a downwardly inserted bolt of a trim ring assembly.

2. The sink mounting means claimed in claim 1 wherein said support member is a leveling bolt adjustably engaged with said inwardly directed flange.

3. The sink mounting means claimed in claim 1 wherein said member of angular section includes an outwardly directed top flange for counter top engagement, said inwardly directed flange including parallel channel members forming said recess, said support member being of elongate configuration and of an elastomeric material.

4. The sink mounting means claimed in claim 2 wherein said upright web is continuous having both straight and curved segments.

5. The sink mounting means claimed in claim 1 wherein said member of angular section is of elongate straight configuration for attachment to a straight edge defining the counter opening.

6. The sink mounting means claimed in claim 1 wherein said member is of elongate curved configuration for attachment to a curved edge defining the counter opening.

7. The sink mounting means claimed in claim 1 additionally including adjustment bars extending intermediate two or more members of angular section, locking means insertable through said bars and said members of angular section to retain the sink mounting means in a desired closed configuration to facilitate installation of same in a unitary manner.

8. The sink mounting means claimed in claim 7 wherein said locking means are pins.

9. The sink mounting means claimed in claim 1 additionally including the surface trim ring assembly, said assembly comprising a continuous ring member adapted to jointly overlie the sink flange and adjacent counter edge, said ring having a plurality of spaced apart anchor bolts depending therefrom inserted engagement with said inwardly directed flange.

10. The sink mounting means claimed in claim 9 wherein said bolts have horizontally turned upper ends and are thereat each adapted for pivotal movement about the horizontal axis of their upper end to facilitate insertion of each bolt through the inwardly directed flange openings.

11. The sink mounting means claimed in claim 12 wherein said bolt upper ends are additionally adapted for axial movement relative the ring to further facilitate bolt insertion within said flange.

12. The sink mounting means claimed in claim 11 wherein said ring member is non-metallic.

* * * * *